US005687838A

United States Patent [19]

Bakx

[11] Patent Number: 5,687,838

[45] Date of Patent: Nov. 18, 1997

[54] CARRIER

[75] Inventor: Martinus C. M. Bakx, Goes, Netherlands

[73] Assignee: The Mead Corporation, Dayton, Ohio

[21] Appl. No.: 665,658

[22] Filed: Jun. 18, 1996

[51] Int. Cl.[6] ..... B65D 75/00

[52] U.S. Cl. ..... 206/147; 206/153; 206/429

[58] Field of Search ..... 206/427, 429, 206/147, 149, 153, 155, 158

[56] References Cited

U.S. PATENT DOCUMENTS

| | | | |
|---|---|---|---|
| 3,097,010 | 7/1963 | Silver . | |
| 3,156,358 | 11/1964 | Randrup . | |
| 3,442,547 | 5/1969 | Skillen . | |
| 3,493,261 | 2/1970 | Funkhouser et al. . | |
| 3,640,563 | 2/1972 | Wood . | |
| 3,860,281 | 1/1975 | Wood | 206/158 |
| 4,180,191 | 12/1979 | Wood | 206/147 |
| 4,190,149 | 2/1980 | Oliff et al. | 206/147 |
| 4,326,628 | 4/1982 | Wood | 206/153 |
| 4,372,599 | 2/1983 | Kiedaisch et al. | 206/153 |
| 5,273,156 | 12/1993 | Harris | 206/147 |
| 5,351,815 | 10/1994 | Fogle et al. . | |
| 5,351,816 | 10/1994 | Sutherland et al. | 206/147 |

FOREIGN PATENT DOCUMENTS

| | | |
|---|---|---|
| 32855/71 | 3/1973 | Australia . |
| 44491/72 | 1/1974 | Australia . |
| 0 042 720 | 12/1981 | European Pat. Off. . |
| 0 134 694 | 3/1985 | European Pat. Off. . |
| 0 170 259 | 2/1986 | European Pat. Off. . |
| 32 06 522 | 9/1983 | Germany . |
| 168547 | 11/1974 | New Zealand . |
| 441 112 | 7/1967 | Switzerland . |
| 092462 | 8/1962 | United Kingdom . |
| 1004118 | 9/1965 | United Kingdom . |
| 1269036 | 3/1972 | United Kingdom . |
| 1316189 | 5/1973 | United Kingdom . |
| 2 154 197 | 9/1985 | United Kingdom . |

*Primary Examiner*—Paul T. Sewell
*Assistant Examiner*—Nhan T. Lam
*Attorney, Agent, or Firm*—Tsugihiko Suzuki

[57] ABSTRACT

An article carrier for packaging a one-row group of bottles is disclosed. The carrier comprises opposed top and bottom walls hingably interconnected by a pair of opposed side walls to form a tubular structure. The top wall is adapted to be disposed over the tops of articles in a row. The bottom wall has article receiving apertures for receiving the necks of the articles respectively. The side walls are adapted to be disposed alongside the necks of the articles such that at least a portion of the neck of each articles is hidden from view. The carrier further comprises article retaining means disposed intermediate the top and bottom walls such that the tops of the articles are retained between the top and bottom walls of the carrier.

8 Claims, 4 Drawing Sheets

CARRIER

BACKGROUND OF THE INVENTION

The invention relates to carriers for articles such as bottles. More particularly the invention relates to carriers which grip the tops of bottles for example.

It is known to provide carriers of the top gripping type which comprise a series of interconnected panels including top, bottom and side panels, and article receiving apertures in the top and bottom panel which receive the neck of a bottle. In order to retain the bottle in the receiving apertures, it is known to provide so-called sun burst features around the periphery of an aperture such that when a bottle is passed through the aperture the plurality of tabs which form the sun burst engage the underside of a bottle cap or protruding flange for example. A top gripping carrier of this type is disclosed in GB 2154197B.

Another type of top gripping carrier is disclosed in EP 42720B1 wherein a triangular formation is shown having top and bottom apertures such that the load of a bottle is transmitted through the triangular side walls adjacent the aperture into the base panel thereby to provide a relatively rigid article gripping device.

There are several problems with known carriers including for example that they expose the bottle cap and that part of the neck label directly beneath the cap which is often damaged and unsightly.

The invention seeks to avoid or at least mitigate these and other problems of the prior art.

SUMMARY OF THE INVENTION

Accordingly, the invention provides an article carrier for packaging necked articles such as bottles, comprising hingably interconnected top, bottom and side walls wherein the bottom wall comprises an article receiving aperture adapted to receive the neck of an article and wherein the carton further comprises article retaining means disposed intermediate the bottom and top wall such that the top of the associated article is retained between the top and bottom of the carrier.

Advantageously the unsightly, damaged label can be screened from the view of a customer purchasing the packaged articles. Additionally, a strong article retaining means can be provided within the carrier.

The carrier of the invention can comprise article retaining means which comprises a retention panel having a bottle top receiving and retaining aperture. The rim of the bottle top receiving and retaining aperture can be upwardly convex so as to provide resistance against downward movement of an associated article engaged therein. The carrier can also comprise an upper support member interconnecting the retention panel and the top wall of the carrier. The retention panel can be hingably connected to the side walls of the carrier.

Preferably the configuration of the carrier panels including the upper wall and retention panel is such as to require distortion of the panel configuration in order to enable removal of an article from the carrier.

Preferably, a carrier according to the invention comprises a plurality of article receiving apertures and associated retaining means configured to carry a linear array of articles.

The carrier can also comprise end closure means which at least partially obscure from view the tops of the articles retained in the carrier. The end closure means can be struck from that part of the carrier which form an article neck receiving aperture and is hingably connected to the rim thereof.

Another aspect of the invention provides a blank for forming a carrier according to the other aspect of the invention.

The blank can comprise a series of hingably interconnected panel portions including longitudinally endmost securing tab, an intermediate panel for forming article retaining means, a central support panel, an upper panel portion, side panel, and base panel portion which panels are repeated about a transverse symmetry axis through one of the panels.

BRIEF DESCRIPTION OF THE DRAWINGS

An embodiment of the invention will now be described, by way of example only, with reference to the accompanying drawings, in which.

DETAILED DESCRIPTION OF THE PREFERRED EMBODIMENTS

Figure 1:
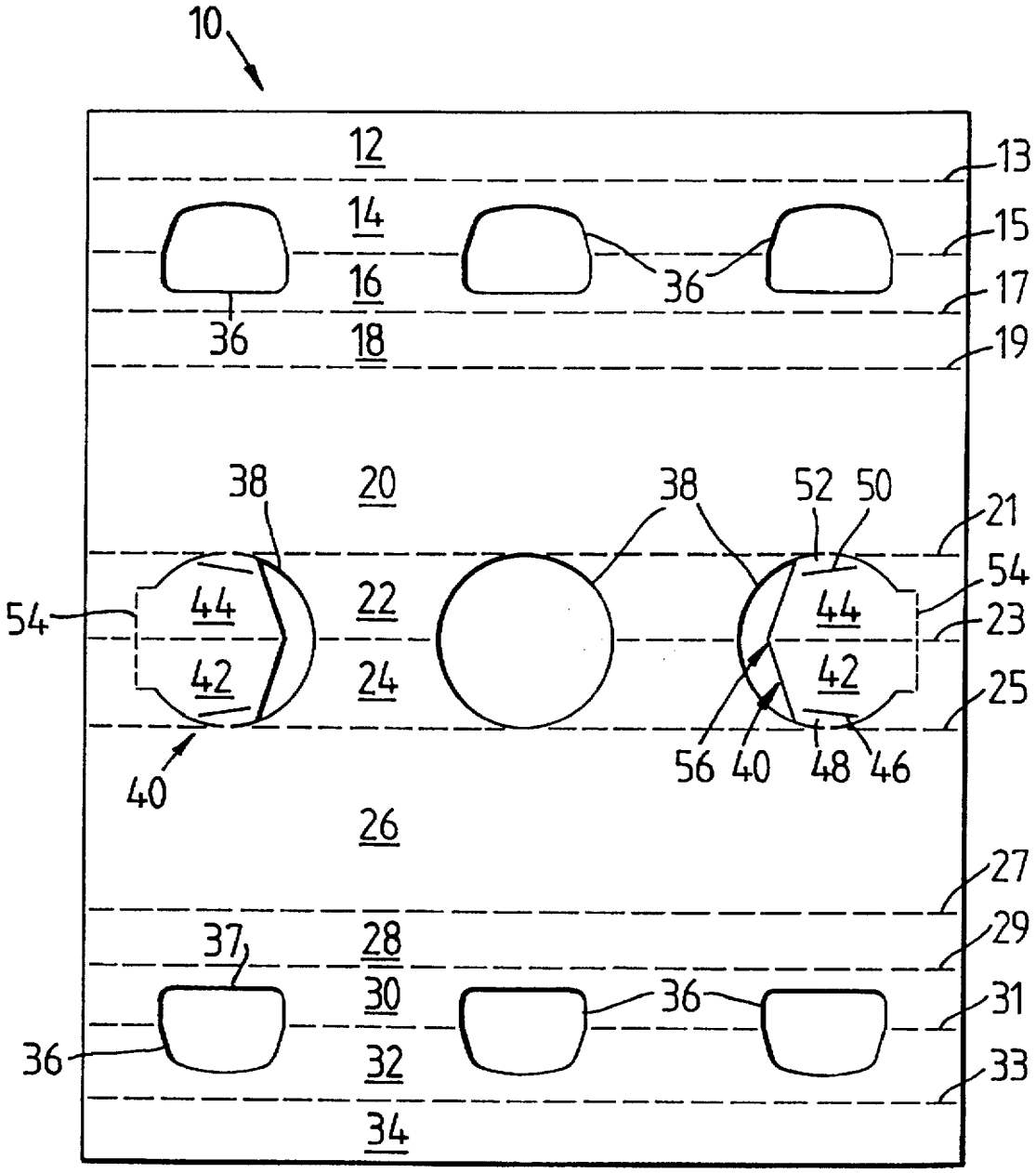
FIG. 1 is a plan view of a blank for forming a carton according to the invention.

Referring to FIG. 1 there is shown a carton blank 10 in a particular form of the invention which is adapted to produce a carton for carrying three necked articles such as bottles. In this particular example, blank 10 is symmetrical about a central transverse fold line 23. The blank comprises at one end a glue tab 12, hinged to an intermediate retention panel 14. The retention panel 14 is hinged to a central support panel 16 along fold line 15 which is interrupted by three article top receiving apertures 36 struck from panels 14 and 16. Central support panel 16 is hinged to top wall panel portion 18 which in turn is hinged to side panel 20. Panel 20 is hinged to base panel portion 22 which in turn is hinged to a second base panel portion 24 along interrupted fold line 23. Due to the reflective symmetry about fold line 23, carton blank 10 therefore comprises side panel 26, upper panel portion 28, central support panel 30, intermediate retention panel 32 and a further glue tab 34.

The base of the carton comprising panels 22 and 24 comprise article neck receiving apertures 38 which interrupt the central fold line 23. In this embodiment, the two endmost apertures 38 have struck therein end closures 40. The end closures 40 are hinged to the base panels 22 and 24 along fold lines 54 and comprise two main panel portions 42 and 44 hingably connected along that part of fold line 23 which extends into the end closures 40. The main panels 42 and 44 comprise lateral tabs 48 and 52 hingably connected to but partially cut from the main end closure panels by cuts 46 and 50 respectively.

Figure 2:
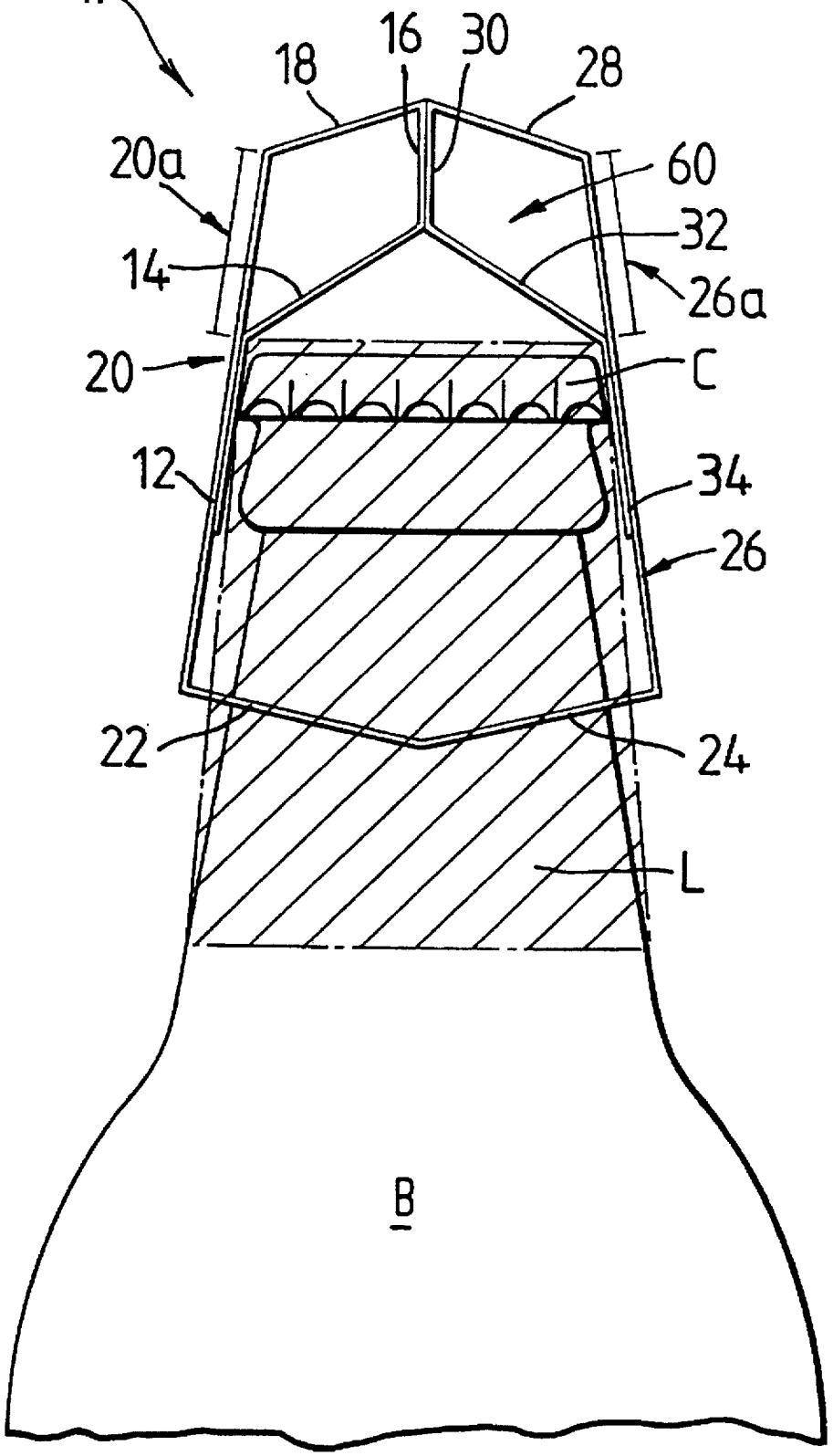
FIG. 2 is an end elevation view of a carton according to the invention showing the article loading process with an end closure removed for clarity.

The end elevation view shown in FIG. 2 shows a carton 11 constructed from blank 10 in which all the carton panels are clearly indicated. It is evident therefore that glue tabs 12 and 34 are adhered to the inside faces of side panels 20 and 26 respectively. The positioning of the glue tabs is such as to bring central support panels 16 and 30 together so that they can be adhered to one another as shown in FIG. 2. In this way, the carton is formed having an upper wall comprising panels 18 and 28, side walls comprising side panel 20 and 26, and a base wall comprising panels 22 and 24. Additionally, the carton 11 comprises article retaining means 60 intermediate the top and bottom walls.

The article retaining means comprises retention panels 14 and 32, and central support panels 16 and 30 which are formed within the carton to provide apertures to receive article tops and retain each article in the carton until it is removed for use. Thus, an aperture is created by two associated apertures 36 from panels 14 and 32 as can be seen from FIG. 3*a*. Means 60 is connected to the top wall of the carrier 11 along fold lines 17 and 29 and to the side walls 20 and 26 along fold lines 13 and 33. In this example the fold lines 13 and 33 are disposed such that side wall panel portions **20*a* and 26*a* are taller than panels 16 and 30 which due to the relative size of the other panels causes panels 14 and 32** to be inclined to the horizontal in the packaged position shown in FIG. 3.

Figure 3:
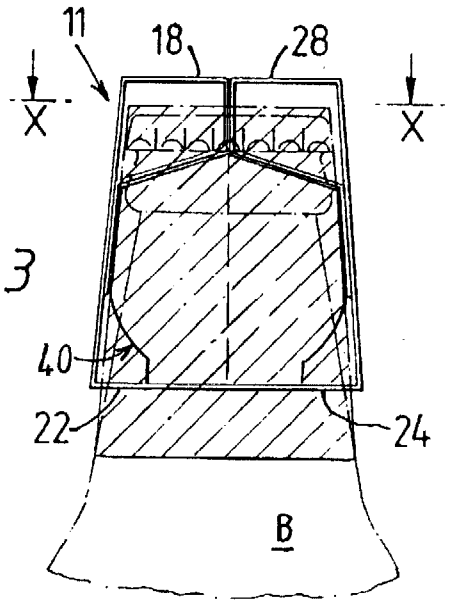
FIG. 3 is an end elevation view of the carton shown in FIG. 2 with an article loaded.
Figure 3A:
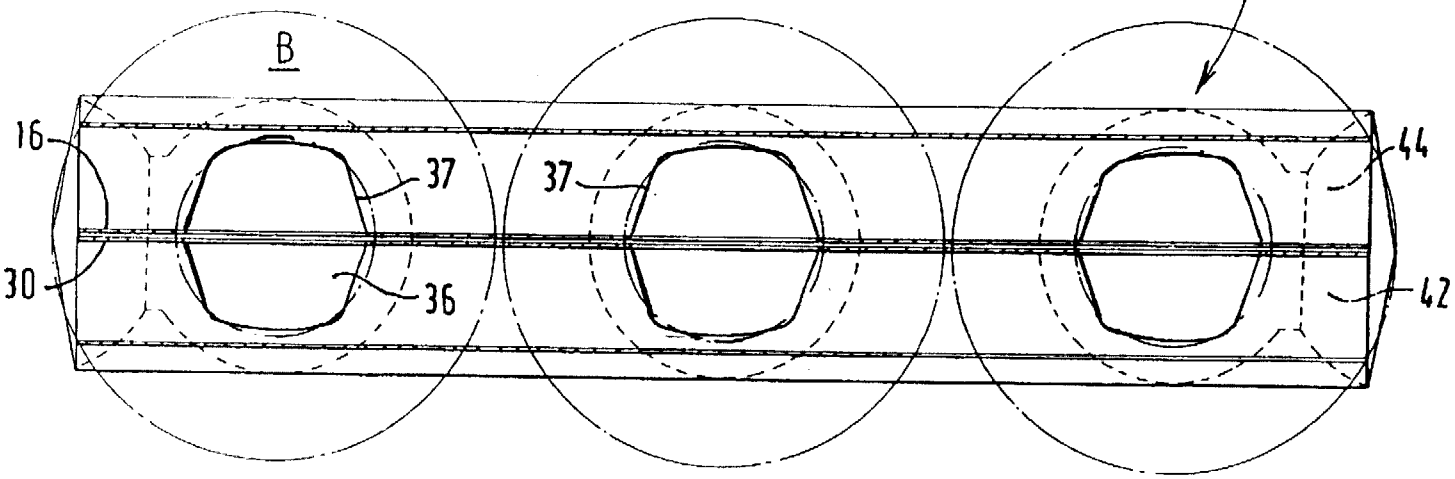
FIG. 3*a* is a sectional plan view along line X—X of the carton shown in FIG. 3.

Referring now the operation of loading carton 11 with a bottle B as shown in FIGS. 2 and 3, it can be seen that carton 11 in its initial position has its top panels 18 and 28 inclined to the horizontal by an angle which is less than that of the intermediate retention panels 14 and 32. A bottle top C is passed through an aperture 38 with little resistance but in order for the cap C to pass through the aperture in intermediate retention panels 14 and 32, the rim 37 of the aperture 36 needs to flex outwardly and only minimal resistance to this movement is presented provided that the carton 11 is made of a blank of suitable resilient material such as medium calliper paperboard, for example. Having passed the carton 11 onto the top of a bottle B as shown in FIG. 3 the carton 11 is positioned so that the top panels 18 and 28 are substantially horizontal or parallel with the top cap of the bottle, and substantially parallel to base panels 22 and 24. Since the base wall is wider than the top wall of the carton 11, the side walls 20 and 26 are inclined to the vertical so as to contour the neck of the bottle. However, the configuration of the internal bottle retaining means 60 is such that intermediate retention panels 14 and 32 are inclined at an angle relative to the planes of the top and bottom panels of the packaged carton. As can be seen from FIG. 2, side panel portions **20*a* and 26*a* are larger than central support panels 30 and 16** respectively.

Figure 4:
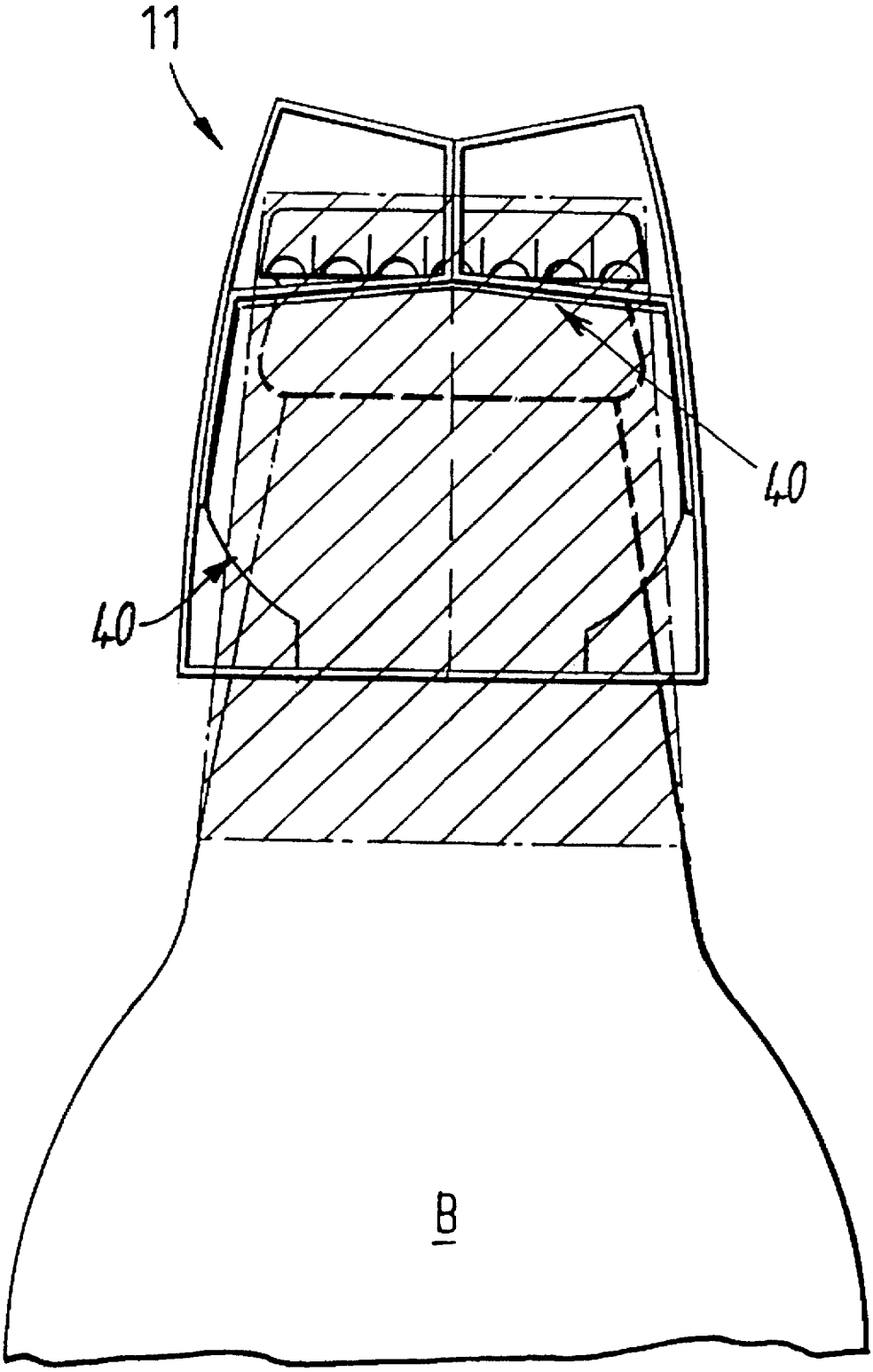
FIG. 4 is an end elevation view of the carton shown in FIGS. 2 and 3 during removal of an article.

In order to remove a bottle B from the carton 11, it is necessary for the bottle caps C to pass back through the associated part of the aperture 36 in the intermediate retention panels 14 and 32. However, the underside of the bottle cap C engages the intermediate retention panels 14 and 32 adjacent the aperture rim 37 thereby restraining further movement of the bottle relative to the carton 11 as can be seen from FIG. 3*a*. As the relative movement continues the bottle cap C forces the intermediate panels 14 and 32 into an alignment substantially parallel to the base panel 22 and 24 as seen in FIG. 4. However, as can be seen in FIG. 4, this movement causes the upper panels 18 and 28 to be drawn downwardly against the natural resistance of the carton structure. Accordingly, a resistive force is presented against the withdrawal of the bottle from the carton 11. This resistance is of course quite different from the action provided when loading the carton due to the relative sizes and configuration of various panels as described earlier. Accordingly a greatly increased force is required to remove the bottle from the carton compared to the force required to load the bottles into the carton. It is thereby found that a suitable carton retaining means can be provided so that for example, the three bottles contained within a carton 11 can be carried without significant risk of a bottle becoming accidentally detached from the carton. Naturally, it would also be possible to provide a handle on the carton.

It is apparent therefore that the carton provides several advantages while enabling good bottle retention in a carton. First, the carton hides from view that part of the bottle label L adjacent the bottle cap C which especially when damaged, can be unsightly from a marketing or aesthetic point of view. Second, the carton hides from view label L that may, for example, be furnished with a single product bar code. It is desirable to hide this single product code when multiple products are sold in a single package. Further, the carton is allowed to have uninterrupted top and side walls that can be used as billboard panels for carrying printed matter such as product designation or advertising material. This can enhance the point of sale presentation of the product.

As well as obscuring from view from the sides of the carrier that part of the label L which might be torn, the carton can also comprise end closures 40 which as shown schematically in FIG. 3 act to obscure the majority of the end view of the bottle neck retained in the carton 11 and particularly that part of the label L directly below the bottle cap C. These end closures 40 can be put into position simply by passing a bottle through the associate aperture 38 and by causing the end closure 40 to pivot about hinge line 54. The end closure 40 is then raised to an upright position wherein friction tabs 48 and 52 fold about hinges at opposite ends of cuts 50 and 46 thereby to retain the end closure 40 in its upright position. Advantageously, the end closure 40 can be contoured at its upper end 56 so as to marry the shape of the underside of intermediate panels 14 and 32 in the formed carton 11. This enables complete screening of the end beneath the intermediate panels 14 and 32 and above the bottom walls 22 and 24 and also enables a further resistance against movement of the intermediate panels 14 and 32 when trying to withdraw a bottle B from carton 11.

What is claimed is:

1. An article carrier for packaging a plurality of articles each having a top and a neck extending downward from the top, the carrier comprising:

opposed top and bottom walls hingably interconnected by a pair of opposed side walls to form a tubular structure of a generally rectangular cross section, the top wall being adapted to be disposed over the tops of the articles in a row, the bottom wall having neck-receiving apertures for receiving the necks of the articles respectively, the side walls being adapted to be disposed alongside the necks of the articles such that the tops of the articles are hidden from view by the side walls; and retaining means for retaining the tops of the articles between the top and bottom walls of the carrier, the retaining means comprising a first retention panel hingably connected to one of the side walls at an intermediate position between the top and bottom walls to engage the tops of the articles, and a first support panel for holding the first retention panel inclined to the top wall such that the first retention panel extends upwardly and inwardly of the tubular structure from the one side wall, the first support panel extending between the top wall and an upper inner end of the first retention panel to interconnect the top wall and the first retention panel.

2. The carrier according to claim 1 wherein the distance between the top wall and the intermediate position is greater than the length of the first support panel extending between the top wall and the first retention panel whereby the first retention panel is held inclined to the top wall.

3. The carrier according to claim 1, further comprising end closure means for at least partially closing open ends of the tubular structure, the end closure means being struck from the bottom wall to define at least one of the neck-receiving apertures and being hingably joined to the bottom wall.

4. The carrier according to claim 1 wherein the one side wall has at the intermediate position a glue tab secured thereto, the first retention panel being hingably connected to the one side wall through the glue tab.

5. The carrier according to claim 1 wherein the retaining means further comprises a second retention panel hingably connected to the other of the side walls at an intermediate position between the top and bottom walls to engage the tops of the articles, and a second support panel for holding the second retention panel inclined to the top wall such that the second retention panel extends upwardly and inwardly of the tubular structure from the other side wall, the second support panel extending between the top wall and an upper inner end of the second retention panel to interconnect the top wall and the second retention panel.

6. The carrier according to claim 5 wherein the first and second support panels are secured together in a face to face contacting relationship to form a center support means disposed generally vertically between the side walls.

7. The carrier according to claim 6 wherein the top wall comprises a pair of first and second panel portions, the first panel portion extending between and hingably joined to the one side wall and an upper end of the first support panel, said second panel portion extending between and hingably joined to the other side wall and an upper end of the second support panel.

8. The carrier according to claim 5 wherein the first and second retention panels in cooperation define top-receiving apertures for receiving the tops of the articles so that the first and second retention panels are engaged at aperture rims thereof with the tops of the articles.

* * * * *